United States Patent [19]

Ragoza et al.

[11] 4,292,820

[45] Oct. 6, 1981

[54] METHOD OF AND APPARATUS FOR KNITTING THE HEEL OF A HOSIERY ARTICLE

[76] Inventors: Igor V. Ragoza, Moskovsky prospekt, 7, kv. 114; Petr M. Begunov, ulitsa Shirokaya, 30, kv. 5; Robert T. Tonikian, ulitsa Chkalova, 11, korpus 10, kv. 92; Petr J. Vasiljuk, ulitsa Chkalova, 11, korpus 12, kv. 79, all of Vitebsk, U.S.S.R.

[21] Appl. No.: 62,181

[22] Filed: Jul. 30, 1979

[30] Foreign Application Priority Data

| | | | |
|---|---|---|---|
| Oct. 20, 1978 | [SU] | U.S.S.R. | 2686186 |
| Jan. 17, 1979 | [SU] | U.S.S.R. | 2704501 |
| Jan. 23, 1979 | [SU] | U.S.S.R. | 2707351 |

[51] Int. Cl.[3] ..... D04B 9/00

[52] U.S. Cl. ..... 66/8; 66/195; 66/178 R; 66/79; 66/5

[58] Field of Search ..... 66/7, 8, 5, 10, 13, 66/135, 178, 185, 187, 195

[56] References Cited

U.S. PATENT DOCUMENTS

| | | | |
|---|---|---|---|
| 732,433 | 6/1903 | Nicholls | 66/10 |
| 732,434 | 6/1903 | Nicholls | 66/10 |
| 1,998,473 | 4/1935 | Welch et al. | 66/8 |
| 2,312,965 | 3/1943 | Goyler et al. | 66/8 |
| 3,570,268 | 3/1971 | Nogues | 66/135 X |

*Primary Examiner*—Ronald Feldbaum

*Attorney, Agent, or Firm*—Lackenbach, Lilling & Siegel

[57] ABSTRACT

The method includes guiding two systems of warp threads to the knitting needles by two systems of thread guides, and moving the latter to knit the main loop courses and additional loop courses which are made between the main loop courses and which are shorter than the latter, with the two systems of the thread guides being moved during the knitting of the additional loop courses along the front presented by the knitting needles, behind the backs thereof and, through steps which are longer than the steps through which these thread guides are moved during the knitting of the main loop courses. The apparatus of the invention comprises a circular warp-knitting machine having knitting members, a mechanism for actuating the annular thread guide bars along the front presented by the knitting needles, and a mechanism for positive feeding of the warp threads of each system. The mechanism for actuating the annular thread guide bars includes additional cams arranged adjacent to the main cams coaxially about the common driving shaft mounted for axial reciprocation to provide for knitting the additional loop courses. The mechanism for positively feeding the warp threads of each system includes an additional rubber-coated roller over which run the warp threads of the two systems, used for forming the edge loops of the additional courses, the roller being resiliently urged against the driving drum and associated with a drive for its positive rotation when disengaged from the driving drum. The method and machine of the invention enhance the strength of the heel of a hosiery article, as compared with the other portions thereof, and also improve its three-dimensional shape.

8 Claims, 9 Drawing Figures

METHOD OF AND APPARATUS FOR KNITTING THE HEEL OF A HOSIERY ARTICLE

FIELD OF INVENTION

The invention relates to methods of manufacturing hosiery or footwear articles, and more particularly it relates to a method of knitting the heel of a hosiery article and to a warp-knitting circular machine capable of performing this method.

BACKGROUND OF INVENTION

There is known a method of knitting the heel of a hosiery article in a circular warp-knitting machine.

In accordance with the said known method the heel of a hosiery article is knitted from two systems of warp threads guided by two thread guide systems being moved both along the front presented by the knitting needles and intermediate these needles. Such method including knitting main loop rows or courses and also knitting therebetween additional loop rows or courses which are shorter than the main ones and are knitted from some of the warp threads of both systems, by disengaging some of the knitting needles along a portion of the circumference of the needle cylinder.

However, when the heel of a hosiery article is knitted in a circular warp-knitting machine by this method, the heel lacks a strengthened loop structure that can be attained in weft-knitting machines. The heel of the warp-knitted article produced by this method wears out sooner than the sole bottom portion thereof. Furthermore, the three-dimensional shape of the heel of a hosiery article knitted by this method is not altogether adequate.

SUMMARY OF THE INVENTION

It is an object of the present invention to enhance the quality of the heel of a hosiery article, to make it stronger than other portions of the article and to improve its three-dimensional shape.

It is another object of the present invention to create a circular warp-knitting machine capable of carrying out the improved method of knitting the heel of a hosiery article.

These and other objects are attained by a method of knitting the heel of a hosiery article in a circular warp-knitting machine, including guiding two systems of warp threads to the knitting needles by two thread guide systems, by moving the latter both along the front presented by the knitting needles and intermediate the needles, and knitting main loop courses. The method further including knitting additional loop courses between main loop courses, which are shorter than the latter, from certain of the warp threads of both systems, by disengaging some of the knitting needles along a portion of the circumference of the needle cylinder. In addition, the two systems of thread guides are moved during the knitting of the additional courses along the front presented by the knitting needles, behind their backs, and through steps which are longer than the steps through which these thread guides are moved during the knitting of the main loop courses.

By increasing the steps or shifts of the thread guides behind the backs of the knitting needles, there an increase in the number of the link portions intersecting the loops proper of the additional courses or rows, whereby the tensile strength of the heel along the additional rows is increased, the rubbing wear resistance of the heel is enhanced, due to the thicker additional courses encountering the wear-inflicting rubbing surfaces instead of the main loop courses, and the height of the additional courses is increased, which improves the three-dimensional shape of the heel.

The invention is further characterized in that the warp threads of both systems, used for forming the margin or edge loops of the additional courses, are fed under a greater tension than that at feeding the rest of the threads, and at a rate that is slower than that of feeding the threads for knitting the rest of the loops of the additional courses. This enables to close over the holes at the edges or margins of the heel portion, and to have a smooth transition from the loop structure of the side pertaining to the instep part of the hosiery article to that of the heel.

It is expedient that the feed rate of the warp threads for knitting the edge loops at one side of the additional courses should be set greater than the feed rate of the warp threads for knitting the edge loops at the opposite side of the additional courses.

To effect the method of the invention, there is disclosed a novel circular warp-knitting machine comprising a needle cylinder with knitting needles and sinkers, two systems of thread guides movable intermediate the knitting needles and arranged in two concentric annular thread guide bars movable along the front presented by the knitting needles by a mechanism for actuating said thread guide bars said front comprising main cams in a number corresponding to that of the guide bars, mounted on a common driving shaft. Said mechanism including respective followers of these main cams are mounted on spring-urged arms operatively connected with the respective guide bars, two warp thread systems, a mechanism for positively feeding the warp threads of each system, a spring-urged rest, the motion-distributing drum of an apparatus controlling the operation of the units of the machine, including a mechanism for disengaging some of the knitting needles during the knitting of the additional loop courses. The mechanism for actuating the thread guide bars along the front presented by the knitting needles includes additional cams having a profile differing from that of the main cams, arranged adjacent thereto coaxially of their common driving shaft which is mounted for axial reciprocation for selectively engaging the additional cams with the followers on the spring-urged arms, for knitting the additional loop courses. The mechanism is operatively connected with the motion-distributing drum of the apparatus controlling the operation of the units of the machine, and the mechanism for positively feeding the warp threads of each system including an additional rubber-coated roller resiliently urged toward its respective driving drum about which those of the warp threads of its thread system are made to run, which are used for forming the edge loops of the additional courses. Such additional roller is mounted for selective disengagement from the respective driving drum of the mechanism for positively feeding the threads and is associated with a drive for rotating this roller in its position of disengagement from the driving drum.

The proposed structure of the mechanism actuating the thread guide bars solves the problem of automatically controlled knitting of a hosiery article with a heel wherein the additional loop courses are being knitted with the thread guides being moved behind the backs of the knitting needles through shifts or steps which are greater than those at knitting the main loop courses. The mechanism is structurally simple and adequately reliable, providing as it does for automatically switching over the machine from one knitting pattern to another one, and being usable for knitting other portions of a hosiery article, and, in general, being usable for producing various tubular warp-knitted articles incorporating special mechanical and decorative annular patterns.

The mechanism for positively feeding the warp threads provides for the automatic switching over from one predetermined thread feed rate or speed, for knitting the edge loops of the additional courses, to another feed rate or speed, as the machine is switched over for knitting the heel, and vice versa.

It is expedient that, in order to effect the axial reciprocation of the common driving shaft carrying the main cams and the additional cams, the machine should include a slide-fork, operatively connected with the motion-distributing drum of the apparatus controlling the operation of the units of the machine, having guide grooves, and a sleeve rotatably received about the common driving shaft and retained against axial motion therealong, the sleeve having studs received in the guide grooves of the slide-fork, and a device retaining this sleeve against joint rotation with the common driving shaft.

The invention is further characterized in that the drive for rotating the additional rubber-coated roller includes a disc-type speed-variation gear of which the driving disc is operatively connected with the shaft of the respective driving drum and the driven disk is secured to the shaft of the additional rubber-coated roller. This provides for dependable engagement and disengagement of the rotation of the additional rubber-coated roller and also provides for infinite adjustment and dependable maintaining of the predetermined speed of rotation of the additional rubber-coated roller while the heel is being knitted.

In accordance with the invention, to effect the selective disengagement of the additional rubber-coated roller from the respective driving drum, the machine includes a system of arms operatively connected with the motion-distributing drum of the apparatus controlling the operation of the units of the machine. The arms are secured on a support shaft extending parallel with the additional rubber-coated roller and have their free ends in permanent engagement with the spring-urged slide blocks which act as the bearings of the shaft of the respective additional rubber-coated roller.

The invention is further characterized in that the additional rubber-coated roller is made up of two parts accommodated on their common shaft, the drive for rotating this roller including two disc-type speed-variation gears arranged at the opposite face ends thereof. The respective driving discs of these speed-variation gears are operatively connected with the shaft of the driving drum, the driven disc of one of the speed-variation gears is mounted on the portion of the common shaft, projecting from the respective part of the additional rubber-coated roller, while the driven disc of the other speed-variation gear is mounted on a sleeve carrying the other part of the rubber-coated roller, rotatably mounted on the common shaft. This enables one to solve the problem of positively feeding the warp threads for the edge loops of the additional courses at two different speeds or rates in a structurally simple manner, while providing for an adequately stable feed rates of the threads in every knitting mode. Both feed rates of the threads for the edge loops are adjustable infinitely and independently.

BRIEF DESCRIPTION OF THE DRAWINGS

Hereinbefore is a detailed description of an example of performing the method of knitting the heel of a hosiery article, and of an embodiment of a circular warp-knitting machine in accordance with the invention, with reference being made to the accompanying drawings, wherein.

DETAILED DESCRIPTION OF THE INVENTION

Figure 1:
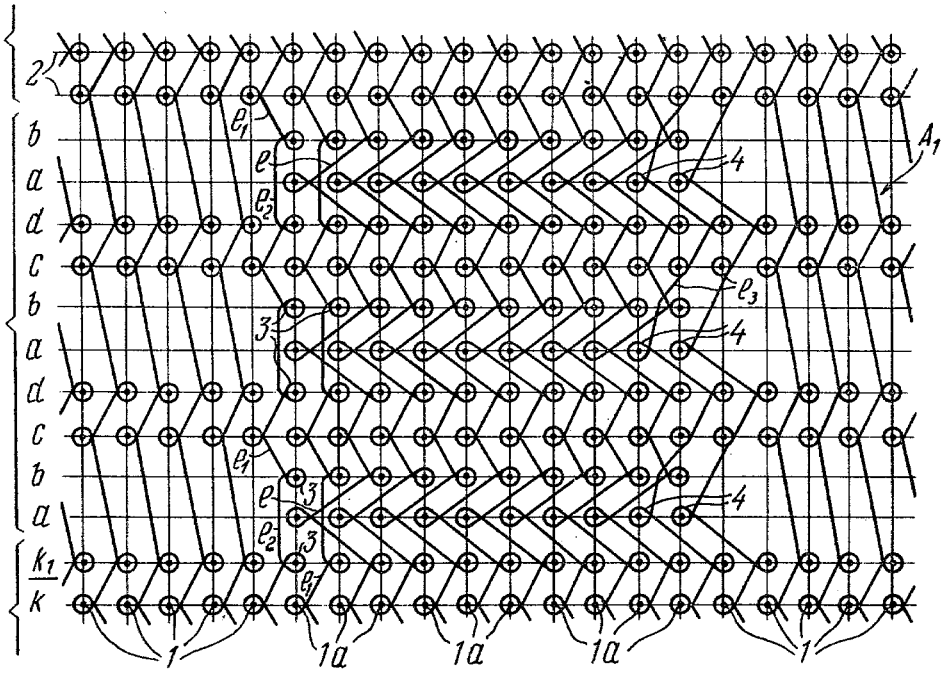
FIG. 1 is a graphic schematic representation of the operation of one of the annular thread guide bars, while it guides the warp threads $A_1$ at the heel-knitting stage of the operation.

Referring now to the appended drawings, there are indicated in FIG. 1 knitting needles 1 which are disabled when additional loop rows or courses "a" and "b" of a heel portion are knitted; knitting needles 1*a* which are engaged in operation permanently, including the stage of knitting the additional loop courses "a" and "b" of the heel portion; the last-but-one row "k" of the loops of the leg portion of the hosiery article; the last row "$k_1$" of loops of the leg portion; full annular main loop coneses "c" and "d" knitted by the needles 1 and 1*a*; annular loop rows 2 of the sole portion of the hosiery article.

The disclosed method of knitting the heel of a hosiery article is effected, as follows, The entire hosiery article is knitted, e.g. by the tricot-tricot knit or stitch pattern, of two warp thread systems $A_1$ and $A_2$ (FIG. 2) directed by two sets of thread guides, with the latter being moved intermediate the needles 1 and 1*a* and also by their being driven in opposing directions along the front presented the by knitting needles, whereby annular main loop courses "$k_1$", "k", "c", "d" and 2 (FIG. 1) are knitted in the article.

The process of knitting the heel portion of the hosiery article is illustrated in FIG. 1 as a graphic representation of the pattern of placing the warp threads $A_1$ of one thread system. The graphic representation of the pattern of the warp threads $A_2$ of the other thread system is identical to that shown in FIG. 1, except that the thread guides move in respectively opposite directions in front of the needles and behind their backs.

Prior to commencing the formation of the heel portion, there are knitted the two last annular rows or courses "k" and "$k_1$" of loops of the leg portion of the hosiery article, with the threads $A_1$ coming from each guide being knitted into loops, e.g. by the tricot knit, at all the needles 1 and 1*a*. When the heel portion is being knitted, there are disabled or disengaged needles 1 along a portion of the circumference of the needle cylinder, and the needles 1*a* which remain operative are used to knit the first two additional loop rows "a" and "b". While guiding the warp threads $A_1$ for knitting the rows "a" and "b", the guides are moved along the front of the knitting needles 1*a* and behind their backs through steps which are greater than the steps of the motion of the same guides while knitting the loop rows "k" and "$k_1$" of the leg portion, e.g. by a single knitting pitch. Consequently, the loops of the additional courses "a" and "b" have straight portions or links "e" which are longer than their counterparts "$e_1$" of the loops of the courses "k" and "$k_1$", or those of the courses "c" and "d".

Following the knitting of the additional courses "a" and "b" with the use of the needles 1*a*, the needles 1 are reengaged for operation, and there are knitted, for instance, two full (annular) main loop courses "c" and "d" by the joint operation of all the needles 1 and 1*a* of the needle cylinder. While the main loop courses "c" and "d" are knitted, the thread guides are driven through the same steps as while knitting the major portions of the hosiery article, including the rows "k", "$k_1$".

Then, the knitting of the additional loop courses "a" and "b" is repeated in the abovedescribed manner, so that these additional courses, "a" and "b" alternate with the main loops courses "c" and "d", which alternation is repeated the predetermined number of times; while the additional loop courses "a" and "b" are being knitted. The warp threads $A_1$ and $A_2$ of both thread systems, participating in the formation of the edge or margin loops of the additional rows 2 "a" and "b", are fed under a tension which is greater than that of feeding the rest of the threads, and at a feed rate which is smaller than the feed rate of the rest of the loops of the additional courses. Due to this, as well as owing to the disengagement of the knitting needles along a portion of the circumference of the cylinder, the straight portions or links "$e_2$" of the edge loops 3 are shorter than the straight portions or links "e", and are arranged as shown in FIG. 1, the arrangement of these links "$e_2$" depending upon the knit pattern used for knitting the hosiery article. The feed rate of the warp threads for forming the edge loops at both sides of the additional courses "a" and "b" may be maintained the same. However, it has been found expedient to have the feed rate of the warp threads at one side of the additional courses "a" and "b", e.g. for knitting loops 4 with links "$e_3$", greater than the feed rate of the threads used for knitting the edge loops at the other side of the additional courses, e.g. the edge loops 3. Since some of the knitting needles are not engaged in knitting the additional courses, the edge loops 3 and 4 and their respective links "$e_2$" and "$e_3$" become arranged as shown in FIG. 1.

Following the completion of the knitting of the heel portion and of its last additional courses "a" and "b", there is commenced the knitting of the annular courses 2 of the sole portion, and of the subsequent portions of the article, by joint operation of the needles 1 and 1*a*.

Figure 2:
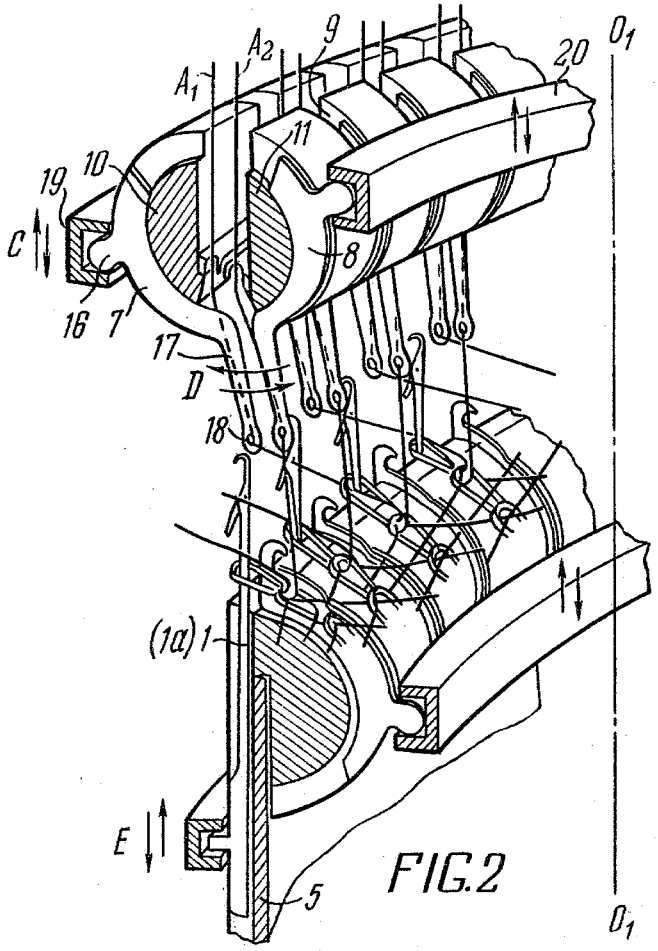
FIG. 2 illustrates the relative arrangement of the knitting members of the circular warp-knitting machine.
Figure 3:
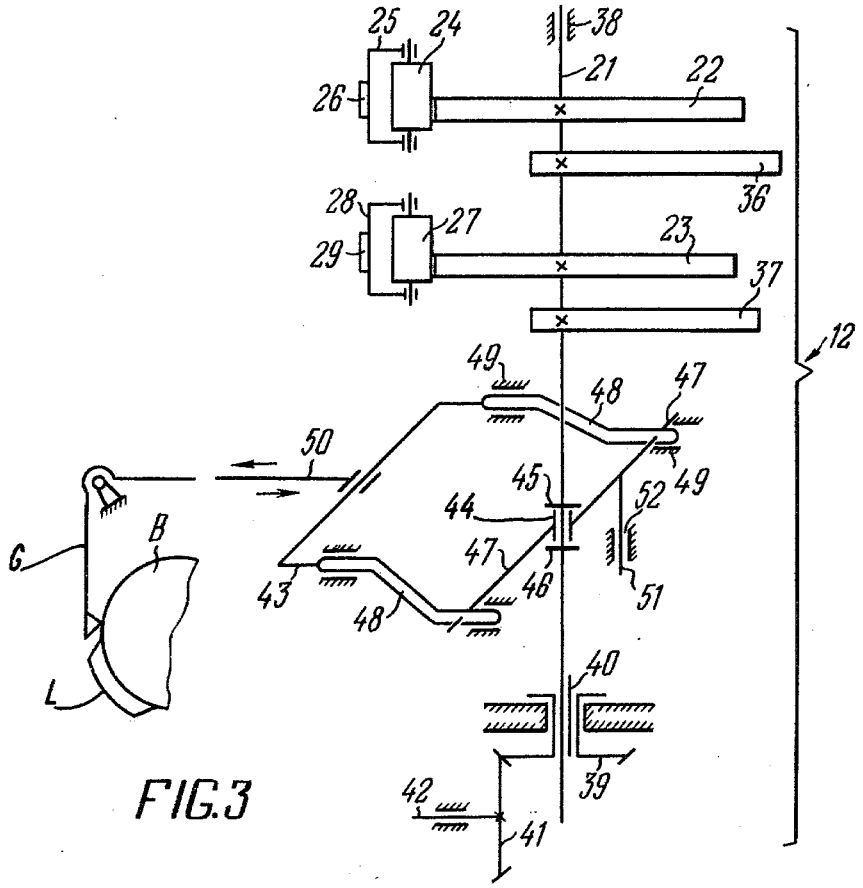
FIG. 3 shows a drive diagram of the mechanism for actuating the annular thread guide bars along the front presented by the knitting needles.
Figure 4:
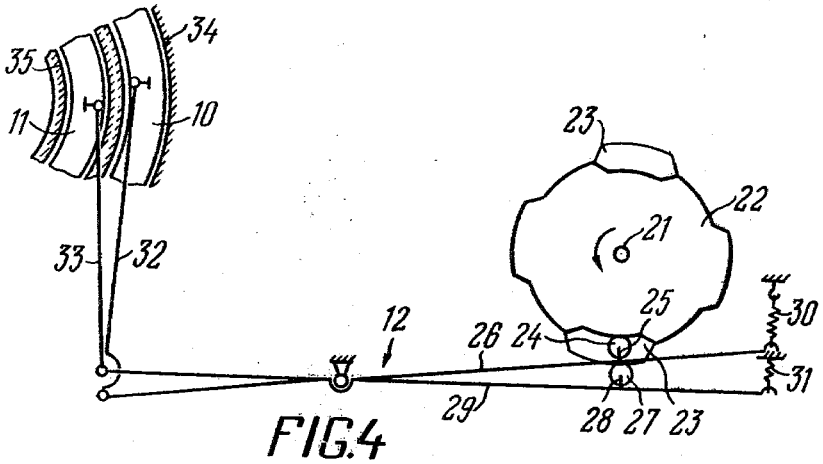
FIG. 4 is a plan view in plan of FIG. 3.

The disclosed method of knitting the heel of a hosiery article is peformed by a circular warp knitting machine which is not shown completely in FIG. 2 so as not to interfere with the description of the essence of the invention. Such machine comprising: a needle cylinder 5 with the needles 1 and 1*a* which are reciprocable in a vertical plane by any suitable means, and sinkers 6 which are movable in the radial direction also by any suitable means; the machine further comprising two systems of eyelet thread guides 7 and 8 movable, between the knitting needles 1 and 1*a* and accommodated respectively, in the slots 9 of two concentrically arranged annular guide bars 10 and 11 movable along the front presented by the knitting needles; a mechanism 12 (FIGS. 3 to 6) for moving the annular guide bars 10 and 11 along the front presented by the knitting needles; two warp thread systems $A_1$ and $A_2$; a mechanism 13 (FIG. 7) for positive feeding of the warp threads of each thread system $A_1$ and $A_2$; spring-urged rests 14 and 15; and an apparatus for controlling the operation of the mechanisms of the machine, including a mechanism for disengaging or disabling some of the needles, i.e. needles 1, at predetermined stages of the knitting process, i.e. at the stages of knitting the additional loop courses, which is generally incorporated in every warp knitting machine, and a motion-distributing or cam cylinder or drum B having a cover plate L (FIG. 3) governing the motion of all the mechanisms through a system of articulated linkages.

It is understandable that beside the abovementioned mechanisms the circular knitting machine comprises other mechanisms and devices providing for operation of the machine in an automatic mode, which are well known to those competent in the art.

The thread guides 7 (FIG. 2) and 8 are in the form of sickle-shaped plates with a round heel portion 16 and an elongated arm 17 with an eyelet 18 for the passage therethrough of the warp threads $A_1$ and $A_2$. The heel portions 16 of the thread guides 7 and 8, respectively, are accommodated in annular internal cams 19 and 20 reciprocable in the direction indicated by the reference arrows C by any suitable known mechanism (not shown in FIG. 2) incorporated in the machine. This reciprocation results in the rocking motion of the thread guides 7 and 8 in the direction indicated by the reference arrows D, which rocking motion moves them intermediate the adjacent pairs of needles 1.

In the circular warp knitting machine embodying the invention, the mechanism 12 (FIGS. 3 and 4) for moving the thread guide bars 10 and 11 jointly with the thread guides 7 and 8 along the front presented by the knitting needles comprises a common driving shaft 21 carrying main cams 22 and 23 rigidly secured thereto. The main cam 22 is engaged by a follower 24 mounted in the bifurcated portion 25 of an arm 26, whereas the main cam 23 is engaged by a follower 27 mounted in the fiburcated portion 28 of an arm 29. The arms 26 and 29 (FIG. 4) are pivotally mounted on the framework and have their respective first ends urged by springs 30 and 31, while their opposite ends are connected via respective rods 32 and 33 with the outer thread guide bar 10 and with the inner thread guide bar 11. The thread guide bars 10 and 11 are mounted in the presently described machine in stationary guideways 34 and 35, respectively, for rotary motion about the central axis $0_1$-$0_1$ (FIG. 2) of the machine. Mounted coaxially on the driving shaft 21 (FIG. 3) adjacent to the main cam 22 is an additional cam 36 paired therewith, while another additional cam 37 is likewise coaxially mounted adjacent to the other main cam 23 and paired therewith. The shaft 21 is mounted for limited axial reciprocation for selective engagement of the additional cams 36 and 37 with the respective followers 24 and 27 mounted on the spring-urged arms and, the shaft 21 is operatively connected to the motion-distributing drum B of the apparatus controlling the operation of the mechanisms of the machine. The axial reciprocation of the shaft 21 is provided for owing to the shaft having one of its end slidably received in the guideway 38 of the machine framework, and its other end received in a bevel gear 39 with which it is operatively connected with aid of a key 40 providing for the sliding motion of the shaft 21 and, the bevel gear 39 meshes with another bevel gear 41 fastened on a shaft 42 connected to the drive of the machine.

To effect axial reciprocation of the shaft 21, the mechanism 12 includes a slide-fork 43 and a sleeve 44 rotatably mounted on the shaft 21 and secured against axial reciprocation therealong in the presently described embodiment with lock rings 45 and 46. The sleeve 44 has two oppositely directed studs 47 received in the slots 48 of the slide fork 43. The latter is accommodated in guideways 49 of the framework and is pivotally connected, e.g. with aid of a rod 50 and a linkage to the motion-distributing drum B. To retain the sleeve 44 against rotation jointly with the driving shaft 21 there is provided a retaining device which in the embodiments being described is in the form of a rod 51 secured to one of the studs 47 and reciprocable in an opening 52 provided in the framework.

Figure 5:
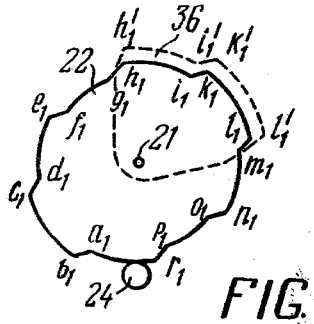
FIG. 5 and FIG. 6 show the profiles and cam fields of the main and additional cams of the mechanism illustrated in FIG. 3.
Figure 6:
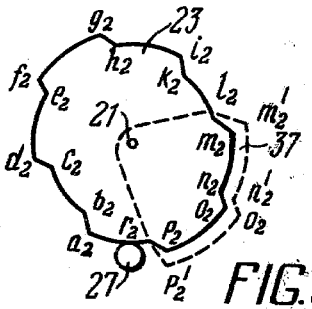
Figure 7:
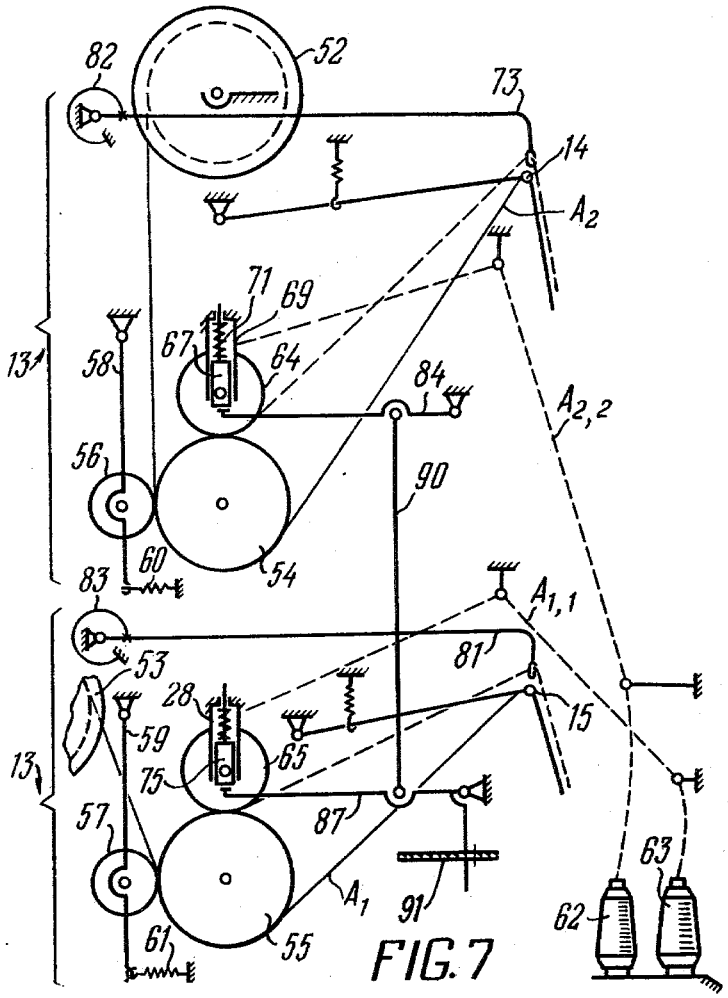
FIG. 7 is a side view illustrating schematically the drive diagram of the mechanisms for positively feeding the warp threads.

Illustrated in FIGS. 5 and 6 are the matched profiles of the main cams 22, 23 and of the additional cams 36 and 37 in their respective relative angular positions.

The main cams 22 and 23 with their respective cam fields $a_1$, $b_1$, $e_1$, $f_1$, $g_1$, $h_1$, $i_1$, $k_1$, $l_1$, $m_1$, $n_1$, $o_1$, $p_1$, $r_1$ and $a_2$, $b_2$, $c_2$, $d_2$, $e_2$, $f_2$, $g_2$, $h_2$, $i_2$, $k_2$, $l_2$, $m_2$, $n_2$, $o_2$, $p_2$, $r_2$ are designed, e.g. for knitting during one revolution of the cams 22 and 23 four courses or rows of tricot knit with closed loops, the two main cams 22 and 23 being relatively angularly staggered about the axis of the driving shaft 21 to provide for knitting the loops of a double-bar tricot-tricot knit with opposing shifts.

The additional cams 36 and 37 (FIGS. 5 and 6) have profiles differing from those of the main cams 22 and 23, shown in FIGS. 5 and 6 with dash lines and including respective fields $g_1$, $h'_1$, $l'_1$, $k'_1$, $l'_1$, $m_1$ and $l_2$, $m'_2$, $n'_2$, $o'_2$, $p'_2$, $r_2$ and are designed, e.g. for knitting in joint operation with the main cams during their one revolution two main courses of the double-bar tricot knit and two additional double-bar courses of the woolen or cloth knit with closed loops. The additional cams 36 and 37 are relatively angularly staggered about the axis of the driving shaft 21 so that jointly with the main cams 22 and 23 they provide for knitting two courses of the double-bar tricot-tricot knit with opposite shifts, and two courses of the double-bar cloth-cloth knit with opposite shifts.

The mechanisms 13 (FIG. 7) for the positive feed of the warp threads $A_1$ and $A_2$ of the two systems include a spool 62 for the warp threads $A_2$ passing through the eyelets of the guides 8 of one system, e.g. of the inner one, and a spool 63 for the warp threads $A_1$ passing through the eyelets of the guides 7 of the other system. e.g. of the outer one. The rubber-coated thread-feeding drums 54 and 55 have mounted thereabove spring-urged thread rests 14 and 15, respectively, and cooperate with rubber-coated pressure rollers 56 and 57 journalled in arms 58 and 59 which are pivotally mounted and urged with respective springs 60 and 61. Mounted separately are spools 62 with warp threads $A_{2,2}$ fed for forming the edge loops 3 and 4 through the guides 8 of the inner system, and spools 63 with warp threads $A_{11}$ fed for forming the edge loops 3 and 4 through the guides 7 of the outer system.

Furthermore, the mechanisms 13 incorporate additional rubber-coated rollers 64 and 65 spring-urged, respectively, to the drums 64 and 65, over which run the warp threads $A_{2,2}$ and $A_{1,1}$ of the two systems, fed for forming the edge loops 3 and 4 of the additional courses "a" and "b".

The additional rubber-coated rollers 64 and 65 are mounted so that they can be disengaged from the respective driving drums 54 and 55, each of them being associated with drive means for rotating them while they are thus disengaged from their driving drums.

Figure 8:
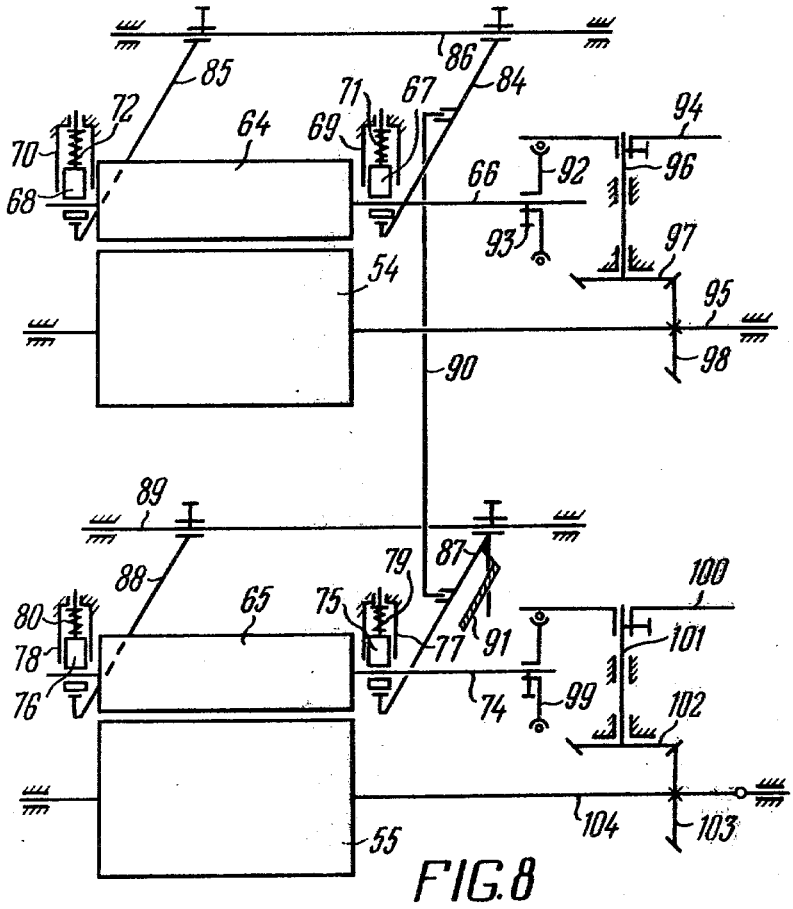
FIG. 8 is a front view of FIG. 7.

The additional rubber-coated roller 64 is mounted on a shaft 66 (FIG. 8) extending above the driving drum 54, the shaft 66 being mounted in slide blocks 67 and 68 acting as the bearings in which the shaft 66 is rotatable. The slide blocks 67 and 68 are mounted in guide frames 69 and 70, respectively, and urged from above by compression springs 71 and 72. Arranged alongside of the thread rest 14 (FIG. 7) are individual identical thread tensioners 73 for each warp thread $A_{2,2}$ fed for forming the edge loops 3 and 4 through the guides 8 of the inner system.

The other additional rubber-coated roller 65 (FIG. 8) is mounted on the shaft 74 extending above the driving drum 55. The shaft 74 is journalled in slide blocks 75 and 76 acting as the bearings for its rotation and mounted in the respective guide frames 77 and 78, with springs 79 and 80 urging them from above. Arranged alongside the rest 15 (FIG. 7) are individual identical thread tensioners 81 for each warp thread $A_{1,1}$ fed for forming the edge loops 3 and 4 through the guides 7 of the outer system.

The thread-tensioners 73 and 81 are spring-urged, e.g. by identical helical springs 82 and 83, respectively.

Underlying the slide blocks 67 (FIG. 8) and 68 in engagement therewith are arms 84 and 85 fast with a support shaft 86; likewise, underlying the slide blocks 75 and 76 are arms 87 and 88 fast with a support shaft 89. The arms 84 and 87 are pivotally interconnected via a rod 90, the arm 87 being a bell crank operatively connected, e.g. via a pull rope 91, with the motion-distributing drum of the apparatus controlling the operation of the machine (not shown), in which way the additional rubber-coated rollers 64 and 65 are selectively disengageable from their respective driving drums 54 and 55. Briefly stated, when the cover plate is under the arm G, the latter turns pulling the ropes 91 which will turn the arms 87 and the arms 88, 85 and 86, thereby disengaging the additional rollers 64, 65 from the driving rollers 54, 55.

The drive for independent rotation of the additional rubber-coated roller 64 includes a known disc-type speed-variation gear of which the driven disc 92 is secured with a retaining screw 93 on the shaft 66, whereas its driving disc 94 is operatively connected to the shaft 95 of the driving drum 54 with the aid of an intermediate shaft 96 to which the driving disc 94 is secured and a bevel gear couple 97, 98 of which the gear 97 is mounted on the shaft 96, and the gear 98 is mounted on the shaft 95.

The drive for independent rotation of the additional rubber-coated roller 65 is similar to the one described hereinabove, its disc-type speed-varying gear including a driven disc 99 mounted on the shaft 74, while its driving disc 100 is mounted on a vertical intermediate shaft 101 operatively connected via a bevel gear couple 102, 103 with the shaft 104 of the driving drum 55.

With the abovedescribed structure of the mechanisms 13 for the positive feed of the warp threads of both systems, there is ensured the same speed of the feeding of the threads for knitting the edge or margin loops 3 and 4 of the additional rows or courses "a" and "b".

Figure 9:
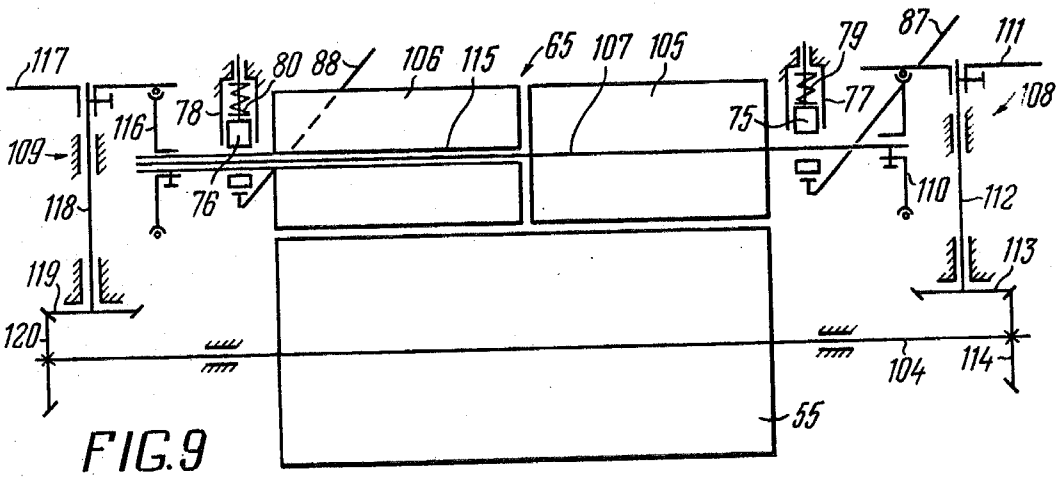
FIG. 9 shows a modified portion of the mechanisms schematically illustrated in FIG. 7, with the additional rubber-coated roller made up of two parts.

Should it be necessary to set the feed rate of the warp threads for the edge loops at one side of the additional courses "a" and "b" higher than the feed rate of the warp threads for the edge loops at the other side of these courses, then, in the modification of the presently described embodiment, the additional rubber-coated rollers are made up each of two parts 105 and 106 (FIG. 9), this modification of the additional rollers 64 and 65 being illustrated with respect to one of the two mechanisms 13, viz. the one for feeding the warp threads of the outer thread guide bar 10, including the roller 65. The two parts 105 and 106 are mounted on their common shaft 107 which is drivable for rotation by two disc-type speed-varying gears 108 and 109 of a known structure, arranged at the face ends of the additional rubber-coated roller 65, i.e. adjacent to its respective two parts or halves 105 and 106.

The part 105 of the roller 65 is mounted on this common shaft 107 the latter of which has mounted on its respective end the slide block 75 and the driven disc 110 of the speed-varying gear 108. The driving disc 111 of this speed-varying gear is mounted on an intermediate vertical shaft 112 which is operatively connected via a bevel gear couple 113 and 114 with the shaft 104 of the driving drum 55.

The other part 106 of the roller 65 is mounted on a sleeve 115 slidably received on the common shaft 107. The end of the sleeve 115, projecting from the part 106, carries the slide block 76 and the driven disc 116 of the speed-varying gear 109. The driving disc 117 of the speed-variation gear 109 is mounted on an intermediate vertical shaft 118 operatively connected via a bevel gear couple 119, 120 with the shaft 104 of the driving drum 55.

The operating principle of the warp-knitting machine of the invention and its operation is as follows.

The process of starting and knitting hosiery article is conducted in the standard way of knitting a double-bar warp-knitted articles, by moving the knitting needles 1 and 1*a* (FIG. 2) in the directions indicated by arrows E and guiding the two warp thread systems $A_1$ and $A_2$ by the two systems of thread guides, viz. the outer one 7 and the inner one 8, the thread guides 7 and 8 being radially rocked intermediate the needles 1 and 1*a* and opposingly reciprocated along the front presented by the knitting needles. In this manner there are produced the main annular loop rows or courses of the articles, in the tricot-tricot knit or stitch fashion, which are permanently pulled behind the backs of the needles 1 and 1*a* by the radially moving sinkers 6.

While the article is being thus knitted, which is also true of its last rows or courses "k" and "$k_1$" (FIG. 1), the feed rate of all the warp threads $A_1$ and $A_2$ is the same, for similar loops are produced at all the knitting needles 1 and 1*a* of the needle cylinder 5 (FIG. 2), the guides 7 and 8 of both systems being similarly shifted along the front presented by the knitting needles. While all of the portions of the article, save its heel portion, are knitted, there are operated the main cams 22 and 23 (FIG. 3) which actuate their respective thread guide bars 10 and 11 via the followers 24 and 27, bifurcated portions 25 and 28, arms 26 and 29, rods 32 and 33 (FIG. 4), the guide bars 10 and 11 being thus driven along the front presented by the knitting needles. With the common shaft 21 carrying the cams 22 and 23 being rotated from the common drive system of the machine via the shaft 42 (FIG. 3), bevel gears 41 and 39 and sliding-connection key 40, the common shaft 21 with the main cams 22, 23 and additional cams 36, 37 carried thereby is in its down position and vertically retained by the slide-fork 43 acting upon the sleeve 44 retained by the lock rings 45 and 46.

In this operating mode, the follower 24 (FIG. 5) successively engages the cam fields $a_1$, $b_1$, $c_1$, $d_1$, $f_1$, $g_1$, $h_1$, $i_1$, $k_1$, $l_1$, $m_1$, $n_1$, $o_1$, $p_1$, $r_1$ of the main cam 22, while the follower 27 (FIG. 6) successively engages the fields $a_2$, $b_2$, $c_2$, $d_2$, $e_2$, $f_2$, $g_2$, $h_2$, $i_2$, $k_2$, $l_2$, $m_2$, $n_2$, $o_2$, $p_2$, $r_2$ of the main cam 23, so that during each revolution of the driving shaft 21 the thread guide bars 10 and 11 (FIG. 4) are actuated through similar steps or shifts along the front presented by the knitting needles 1 and 1*a*, which is required for knitting the main loop courses of the double-bar stitch, pattern e.g. in the tricot-tricot knit fashion.

When the machine is switched over to the mode of knitting the heel of the hosiery article, i.e. the one including knitting the additional rows or courses "a" and "b", the motion-distributing cam drum B (FIG. 3) of the apparatus controlling the operation of the units of the machine actuates the rod 50 to move the fork-slide 43 normally to the driving shaft 21, which fork-slide 43 acts by its guide grooves 48 upon the studs 47 to raise the common driving shaft 21 with its main cams 22, 23 and additional cams 36, 37 via the sleeve 44 and the lock ring 45. In its raised position the driving shaft 21 is retained vertically by the lock rings 45 and 46, the sleeve 44 and the fork-slide 43 acting together.

With the common driving shaft 21 having been thus raised to the up position, the shaft goes on rotating from the gear 39, owing to the incorporation of the key connection 40, while the followers 24 and 27 become engaged by the additional cams 36 and 37, while they are not disengaged from the main cams 22 and 23. Consequently, during each revolution of the shaft 21 the follower 24 successively engages the fields $m_1$, $n_1$, $o_1$, $p_1$, $r_1$, $a_1$, $b_1$, $c_1$, $d_1$, $e_1$, $f_1$, $g_1$ of the main cam 22 (FIG. 5) and the fields $g_1$, $h'_1$, $i'_1$, $k'_1$, $l'_1$, $m_1$ of the additional cam 36, while the follower 27 (FIG. 6) during each revolution of the driving shaft 21 successively engages the fields $r_2$, $a_2$, $b_2$, $c_2$, $d_2$, $e_2$, $f_2$, $g_2$, $h_2$, $i_2$, $k_2$, $l_2$ of its respective main cam 23 and the fields $l_2$, $m'_2$, $n'_2$, $o'_2$, $p'_2$, $r_2$ of the additonal cam 37. Hence, while the two main loop courses "c" and "d" (FIG. 1) are being knitted in the heel portion by all the knitting needles, the cams 22, 23 (FIGS. 5 and 6) actuate the thread guides through opposing shifts, e.g. for making the loops in the double-bar tricot-tricot knit fashion, whereas while the two additional rows or courses "a" and "b" are being knitted by only certain ones 1*a* of the knitting needles, the cams 22, 36, 23 and 37 actuate the guide bars 10 and 11 along the front presented by the knitting needles, behind their backs, through shifts or steps which are greater than those associated with the knitting of the main loops rows or courses "c" and "d". Consequently, the additional courses "a" and "b" are knitted in the double-bar knit fashion, e.g. of the cloth-cloth or woolen-woolen kind. Therefore, during a full revolution of the shaft 21 with the cams 22, 36 and 23, 37 carried thereby there is carried out a full cycle of forming two main courses "c"

and "d" by all the knitting needles 1 and 1*a*, and of two additional courses "a" and "b" by the needles 1*a*.

With the heel portion of the article completed, the apparatus controlling the operation of the machine units actuates the rod 50 (FIG. 3) to retract the slide-fork 43 and thus to lower the common driving shaft 21 into its initial down position, in which position it is retained. The additional cams 36 and 37 thus lower jointly with the shaft 21 and become disengaged from the respective followers 24 and 27, so that the thread guide bars 10 and 11 are moved along the front presented by the knitting needles solely under the action of the main cams 22 and 23.

The driving shaft 21 may be vertically actuated only while the two followers 24 and 27 are engaging the fields of the cams 22 and 23, which, as it has been made clear hereinabove, are operated in both operating modes, as it can be easily comprehended by a person skilled or competent in the art.

The rod 52 retains the sleeve 44 against rotation jointly with the shaft 21.

The additional cams 36 and 37 may be independently mounted on the driving shaft 21, or else they may be mounted directly on the side surfaces of their respective main cams 22 and 23 with which they are paired.

While the additional courses "a" and "b" of the heel portion of the article are being knitted, the warp threads $A_{1,1}$ and $A_{2,2}$ of both systems used for forming the edge of margin loops 3 and 4 of these courses are fed under a greater tension than the threads $A_1$, $A_2$ used for forming the rest of the loops of these courses "a" and "b", and at a rate which is slower than the feed rate of the threads $A_1$ and $A_2$ used for forming these other loops of the additional courses, the warp threads $A_2$ (FIG. 7) from the spool 52 passing through the nip of the rubber-coated driving thread-feeding drum 54 and the rubber-coated pressure roller 56, whereby the threads $A_2$ are unwound from the spool 52, run about the driving drum 54, whereafter they run about the spring-urged rest 14 and come to the thread guides 8, to be knitted into the loops of the main courses "c" and "d" of the heel portion of the article, and into the loops of the additional courses "a" and "b", save the edge or margin loops 3 and 4.

Similarly, the warp threads $A_1$ are unwound by the nip of the driving drum 55 and the pressure roller 57 off the spool 53, run about the spring-urged rest 15 and are fed through the thread guides 7, to be knitted into the loops of the main courses "c" and "d" and into those of the additional courses "a" and "b", save the edge or margin loops 3 and 4.

The threads $A_{2,2}$ of one of the systems, used for forming the edge or margin loops 3 and 4 of the additional courses "a" and "b" of the heel portion, are unwound each off its respective spool 63 by the additional rubber-coated roller 64 which is positively rotated, whereafter they run through the thread-tensioners 73 and come to the thread guides 8 of the inner system.

The threads $A_{1,1}$ of the other system are, likewise used for forming the edge or margin loops 3 and 4 of the additional courses "a" and "b" of the heel portion, and are unwound each off its respective spool 63 by the additional rubbercoated roller 65 which is positively rotated, and then run through the thread-tensioners 81 and come to the thread guides 7 of the outer system. The driving drums 54 and 55 are rotated at a predetermined angular speed by their carrier driving shafts 95 and 104, respectively, operatively connected to the main drive of the machine. While all the loops of the article except those of the heel are being knitted, the feed rate of the warp threads $A_1$, $A_2$, $A_{1,1}$ and $A_{2,2}$ is the same. In this mode of operation of the machine, the additional rubber-coated rollers 64 and 65 are urged by the springs 71, 72 and 79, 80 through the slide blocks 67, 68 and 75, 76 and shafts 66, 74 against the respective driving drums 54 and 55 and are rotated thereby at the same peripheral speed as that of these drums 54 and 55, the pull rope 91 being slack, and the arms 84, 85, 87 and 88 (FIG. 8) exerting no action upon the slide blocks 67, 68, 75 and 76, and the driving discs 94 and 100 and the driven ones 92 and 99 of the respective speed-variation gears being disengaged.

When the machine is switched over to the heel knitting mode, the rope 91 is pulled by the motion-distributing cylinder of the apparatus controlling the operation of the machine, to turn and retain the arm 87 and also, via the shaft 89, the arm 88; and also to turn and retain the arm 84 via the rod 90, and to turn the arm 85 via the shaft 86. Consequently, the arms 84, 85, 87 and 88 force the respective slide blocks 67, 68, 75 and 76 against the efforts of the springs upwardly in the guide frames 69, 70, 77 and 78. This upward motion of the slide blocks 67 and 68 raises the shaft 66 together with the additional rubber-coated roller 64 for feeding the warp threads $A_{2,2}$ and with the driven disc 92 of the respective speed-variation gear, while the upward motion of the slide blocks 75 and 76 raises the shaft 74 together with the additional rubber-coated roller 65 for feeding the warp threads $A_1$, and the driven disc of the respective speed-variation gear. This results in the additional rollers 64 and 65 becoming disengated from the respective driving drums 54 and 55, and the driven discs 92 and 99 of the speed-variation gears engaging their driving discs 94 and 100, respectively, whereby the rollers 64 and 65 are rotated at a predetermined peripheral speed which is lower than that of the driving drums 54 and 55, and the feed rate of the threads $A_{2,2}$ and $A_{1,1}$ is altered.

With the knitting of the heel portion of the article completed, the pull rope 91 is relieved by the corresponding action of the apparatus controlling the operation of the units of the machine, whereby the arm 87 becomes released, same as the arms 88, 84 and 85. The slide blocks 67, 68, 75 and 76 are driven downward by the effort of their respective springs 71, 72, 79 and 80, together with the shafts 66 and 74, whereby the discs of the speed-variation gears become disengaged, while the additional rubber-coated rollers 64 and 65 are urged into engagement with the respective drums 54 and 55 to receive rotation therefrom.

The adjustment of the feed rate of the threads $A_{2,2}$ used for knitting the edge or margin loops 3 and 4 is done by moving the driven discs 92 and 99 along the respective shafts 66 and 74 and retaining them in the adjusted position. The adjustment of the reliability of the engagement of the discs of the speed-variation gears is done by moving the driving discs thereof along the respective vertical shafts 96 and 101, and retaining them in said adjusted positions.

The operation of the additional rubber-coated rollers in the modification where the rollers are made up each of two parts 105 and 106 (FIG. 9) is, as follows.

With the feed rate of all the threads $A_2$, $A_{2,2}$, $A_1$ and $A_{1,1}$ being the same, the arms 87 and 88 are maintained by the apparatus controlling the operation of the units of the machine in the down position, whereby at one side the spring 80 acts through the slide block 75 and the shaft 107, and at the other side the spring 79 acts through the slide block 75 and the shaft 107, to urge the two parts 105 and 106 of the rubber-coated roller against the surface of the rubber-coated driving drum 55, so that the two parts 105 and 106 making up the rubber-coated roller are rotated at a peripheral speed equalling that of this rubber-coated driving drum 55. Correspondingly, all of the warp threads fed by the drum 55 and by the two parts 105 and 106 of the rubber-coated roller have the same positive feed rate. In this operating mode, the discs 111 and 110 of the speed-variation gear 108 and the discs 116 and 117 of the speed-variation gear 109 are spaced, so that no rotation is transmitted thereby to the shaft 107.

When the machine is switched over for the heel knitting mode, the action of the apparatus controlling the operation of the units of the machine makes the arms 87 and 88 have their respective ends urging the slide blocks 75 and 76 against the resistance of the compressed springs 79 and 80. As a result, the two parts 105 and 106 of the rubber-coated roller become disengaged from the surface of the driving rubber-coated drum 55, and the driven discs 110 and 116, respectively, of the speed-variation gears 108 and 109 which engage their driving discs 111 and 117 which are permanently rotated from the shaft 104 of the driving rubber-coated drum 55, respectively, through the bevel gear couples and the vertical shafts 112 and 118. In this heel knitting mode one part 105 of the rubber-coated roller is rotated by its carrier shaft 107 from the disc 110 of the speed-variation gear 108 at one speed, while the other part 106 of the rubber-coated roller receives rotation through its carrier sleeve 115 from the disc 116 of the speed-variation gear 109 at a different speed. The respective angular speeds of rotation of the two parts 105 and 106 of the rubber-coated roller are adjustable by the disc 110 being moved adjustment-wise longitudinally of the shaft 107 and retained in the adjusted position with a retaining screw, and by the disc 116 likewise being moved adjustment-wise longitudinally of the sleeve 115 and retained in the adjusted position with the retaining screw.

With the knitting of the heel completed, the arms 87 and 88 are lowered by the action of the apparatus controlling the operation of the units of the machine, and the effort of the springs 79 and 80 returns the parts 105 and 106 of the rubber-coated roller into their initial position.

What is claimed is:

1. A method of knitting the heel of a hosiery article with two warp thread systems in a circular warp-knitting machine, including: guiding or laying two systems of warp threads on knitting needles by means of two systems of thread guides, actuating these thread guides for displacement both along the front presented by the knitting needles and intermediate these needles, knitting main loop courses and additional loop courses; knitting said additional loop courses between the main loop courses and making them shorter than the main loop courses, from some of the warp threads of the two warp thread systems, by disengaging some of the knitting needles along a portion of the circumference of the knitting cylinder; while knitting said additional loop courses, and actuating both systems of the thread guides along the front presented by the knitting needles, behind their backs, through steps which are greater than the steps through which these thread guides are actuated, while knitting the main loop courses.

2. A method of claim 1, wherein the warp threads of both systems, employed at forming the edge loops of said additional courses, are fed under a greater tension than that of feeding the rest of the warp threads, and at a feed rate which is slower than that of feeding the warp threads for knitting the rest of the loops of said additional courses.

3. A method of claim 2, wherein the feed rate of the warp threads for knitting the edge loops at one side of said additional courses is set greater than the feed rate of the warp threads for knitting the edge loops at the other side of said additional rows.

4. In a circular warp-knitting machine comprising: a needle cylinder with movable knitting needles and sinkers; two systems of warp thread guides movable intermediate said knitting needles; two concentrically arranged annular thread guide bars, accommodating said systems of thread guides; a mechanism for actuating said thread guide bars along the front presented by said knitting needles, including a common driving shaft, main cams in a number corresponding to that of said thread guide bars, mounted on said common driving shaft, followers engageable with said main cams and spring-urged arms carrying said followers, operatively connected with the respective ones of said thread guide bars; two systems of warp threads; a mechanism for positively feeding the warp threads of each said system, including the driving drum and spring-urged rest means; the motion-distributing drum controlling the operation of the units of the machine, including a mechanism adapted for disengaging some of said knitting needles for knitting additional loop courses; the improvement residing in that said mechanism for actuating said thread guide bars along the front presented by said knitting needles including: additional cams having a profile differing from that of said main cams, mounted adjacent to said main cams coaxially with said common driving shaft, said common driving shaft being mounted for axial reciprocation for selectively engaging said additional cams with said followers on said spring-urged arms, for knitting the additional loop rows, and being operatively connected with said motion-distributing drum of the apparatus controlling the operation of the units of the machine; means for effecting this axial reciprocation of said common driving shaft; said mechanism for positively feeding the warp threads of each said warp thread system including an additional rubber-coated roller resiliently urged toward said driving drum and adapted to have those of the warp threads of both said systems running thereabout, which are employed for forming the edge loops of the additional courses; said additional rubber-coated roller being mounted for selective disengagement from said driving drum of said mechanism for positively feeding the warp threads and being associated with drive means for rotating said additional rubber-coated roller in its position of disengagement from said driving drums; and means for selectively disengaging said additional rubber-coated roller from said driving drum.

5. A circular warp-knitting machine of claim 4, wherein said means for effecting the axial reciprocation of said common driving shaft includes: a slide-fork operatively connected with said motion-distributing drum of the apparatus controlling the operation of the units of the machine; guide cam grooves in said slide-fork; a sleeve rotatably mounted on said common driving shaft of said mechanism for actuating said thread guide bars and retained thereon against axial motion therealong;

studs of said sleeve, received in said grooves of said slide-fork; and means retaining said sleeve against rotation jointly with said common driving shaft.

6. A circular warp-knitting machine of claim 4, wherein said drive means for rotating said additional rubber-coated roller includes a disc-type speed-variation gear wherein the driving disc is operatively connected with the shaft of said driving drum of said mechanism for positively feeding the warp threads, and the driven disc is mounted on the shaft of said additional rubber-coated roller.

7. A circular warp-knitting machine of claim 4, wherein said means for selectively disengaging said additional rubber-coated roller from said driving drum includes; springurged slide blocks acting as bearings of the shaft of said additional rubber-coated roller; a system of arms operatively connected with said motion-distributing drum of the apparatus controlling the operation of the units of the machine; a supporting shaft extending parallel with said additional rubber-coated roller; and each said arm of the system having one of its end secured on said supporting shaft and its other end maintained in permanent engagement with the respective one of said spring-urged slide blocks.

8. A circular warp-knitting machine of claim 4, wherein said additional rubber-coated roller is made up of two parts received about their common shaft; drive means for rotating said parts of said rubber-coated roller, including two disc-type speed-variation gears of which the driving discs are operatively connected with the shaft of said driving drum of said mechanism for positively feeding the warp threads; the driving disc of one of said two speed-variation gears being mounted on the portion of the shaft common for said two parts of said additional rubber-coated roller, projecting from one said part thereof; a sleeve rotatably mounted on said last-mentioned common shaft, carrying the other said part of said additional rubber-coated roller; and the driven disc of the other one of said two speed-variation gears being mounted on said sleeve.

* * * * *